US009682402B2

(12) United States Patent
Heron et al.

(10) Patent No.: US 9,682,402 B2
(45) Date of Patent: Jun. 20, 2017

(54) APPARATUS AND METHOD FOR RESTRICTING SPRAY COATING DEPOSITION

(71) Applicants: Jason T. Heron, Lancaster, CA (US); Carlos Diaz, Palmdale, CA (US)

(72) Inventors: Jason T. Heron, Lancaster, CA (US); Carlos Diaz, Palmdale, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 14/799,214

(22) Filed: Jul. 14, 2015

(65) Prior Publication Data

US 2017/0014848 A1 Jan. 19, 2017

(51) Int. Cl.

| | |
|---|---|
| ***B05D 1/32*** | (2006.01) |
| ***B05B 15/04*** | (2006.01) |
| ***B05D 1/02*** | (2006.01) |

(52) U.S. Cl.

CPC ..... *B05D 1/32* (2013.01); *B05B 15/045* (2013.01); *B05B 15/0437* (2013.01); *B05D 1/02* (2013.01)

(58) Field of Classification Search

None

See application file for complete search history.

(56) References Cited

U.S. PATENT DOCUMENTS

| | | | | |
|---|---|---|---|---|
| 2,676,114 | A * | 4/1954 | Barkley | C23C 14/042 427/164 |
| 3,627,569 | A | 12/1971 | Beecham | |
| 4,469,719 | A | 9/1984 | Martin | |
| 8,163,337 | B2 | 4/2012 | Guerin et al. | |
| 2002/0059903 | A1 | 5/2002 | Hasegawa et al. | |

* cited by examiner

*Primary Examiner* — Michael P Rodriguez

(74) *Attorney, Agent, or Firm* — Tarolli, Sundheim, Covell & Tummino LLP

(57) ABSTRACT

An apparatus for selectively restricting deposition of a spray coating on a substrate surface includes at least one substrate-contacting stabilizer with a lower stabilizer surface which is selectively attachable to the substrate surface. A restrictor fin has a fin body having longitudinally separated upper and lower fin surfaces. An inner fin edge is connected to an inner stabilizer edge with an obtuse angle formed therebetween when viewed in a lateral-longitudinal plane. A plurality of transversely oriented fin apertures extend through the fin body. Each laterally adjacent pair of fin apertures defines a transversely oriented restrictor bar from the fin body interposed laterally therebetween. The fin apertures permit at least a portion of the spray coating to pass substantially longitudinally therethrough toward the substrate surface. The restrictor bars selectively prevent passage of at least a portion of the spray coating toward the substrate surface.

7 Claims, 12 Drawing Sheets

APPARATUS AND METHOD FOR RESTRICTING SPRAY COATING DEPOSITION

TECHNICAL FIELD

This disclosure relates to an apparatus and method for restricting spray coating deposition and, more particularly, to a method and apparatus for selectively restricting deposition of a spray coating on a substrate surface of a substrate.

BACKGROUND

Often, in manufacturing use environment, it is desirable to provide a spray coating to a substrate (e.g., a vehicle panel) that tapers from full thickness to a reduced thickness (or zero thickness) over a certain distance along the substrate. For example, if the coating is only desired over a central portion of the entire surface of the substrate, the taper could gradually reduce the coating thickness near the edge of that coated area to avoid an abrupt vertical "step" or "cliff" along the substrate surface.

This tapering is currently done by laying out staggered layers of masking tape on the substrate. However, known masking tape edge taper techniques are only effective over relatively short taper lengths for single-pass coating. Any longer, more gradual, taper length requires multiple coating passes, with the tape layers being manually removed between layers of the coating process. This and other known masking techniques often cause defects in coatings and are relatively labor intensive to use in manufacturing due at least to the precise tape positioning (sometimes difficult to reproduce with known flexible tape products) and the regimented removal required for all but relatively short taper lengths. Currently used shadow masking techniques also can cause a "dry spray" defect and/or an undesirably "stepped" aspect to the tapered areas of coating.

SUMMARY

In an embodiment, an apparatus for selectively restricting deposition of a spray coating on a substrate surface of a substrate is described. At least one substrate-contacting stabilizer has laterally spaced inner and outer stabilizer edges separated by a stabilizer body having longitudinally separated upper and lower stabilizer surfaces. The lower stabilizer surface is selectively attachable to the substrate surface. A restrictor fin has laterally spaced inner and outer fin edges separated by a fin body having longitudinally separated upper and lower fin surfaces. The inner fin edge is connected to the inner stabilizer edge with an obtuse angle formed therebetween when viewed in a lateral-longitudinal plane. A plurality of transversely oriented fin apertures extend through the fin body to place the upper and lower fin surfaces in fluid communication. Each laterally adjacent pair of fin apertures defines a transversely oriented restrictor bar from the fin body interposed laterally between the laterally adjacent pair of fin apertures. The apparatus is configured to affect at least a portion of a spray coating directed substantially longitudinally onto the upper fin surface when the lower stabilizer surface is attached to the substrate surface. The fin apertures permit at least a portion of the spray coating to pass substantially longitudinally therethrough toward the substrate surface. The restrictor bars selectively prevent passage of at least a portion of the spray coating toward the substrate surface.

In an embodiment, a method for selectively restricting deposition of a spray coating on a substrate surface of a substrate is described. The spray coating is directed substantially longitudinally downward from a coating source toward the substrate surface. At least a portion of the spray coating is blocked from reaching the substrate surface via a first substantially transversely extending restrictor bar located a first longitudinal distance above the substrate surface. At least a portion of the spray coating is blocked from reaching the substrate surface via a second substantially transversely extending restrictor bar located a second longitudinal distance, which is less than the first longitudinal distance, above the substrate surface. The second restrictor bar is laterally spaced from the first restrictor bar.

In an embodiment, an apparatus for selectively restricting deposition of a spray coating on a substrate surface of a substrate is described. A shadow mask includes a plurality of mask apertures. The shadow mask primarily comprising a substantially planar mask body having laterally separated first and second mask edges. The mask apertures each penetrate entirely through the mask body in a direction substantially normal thereto. A mask support extends from the first mask edge at an obtuse angle. The mask support is selectively attached to the substrate surface and, when attached to the substrate surface, maintains the shadow mask in a cantilevered relationship with the first mask edge directly adjacent to the substrate surface and the mask body extending from the mask support at the obtuse angle to suspend the second mask edge substantially longitudinally above the substrate surface. The apparatus is configured to affect at least a portion of a spray coating directed substantially longitudinally downward toward the substrate surface from a coating source with the shadow mask interposed longitudinally between the coating source and the substrate surface. The mask apertures each allow passage therethrough of a predetermined portion of the total amount of spray coating provided. The predetermined portion reaches the substrate surface responsive to the physical configuration of the mask apertures to create a predetermined cross-sectional profile, when viewed in a lateral-longitudinal plane, of spray coating upon the substrate surface.

BRIEF DESCRIPTION OF THE DRAWINGS

For a better understanding, reference may be made to the accompanying drawings, in which.

DESCRIPTION OF ASPECTS OF THE DISCLOSURE

This technology comprises, consists of, or consists essentially of the following features, in any combination.

Figure 1:
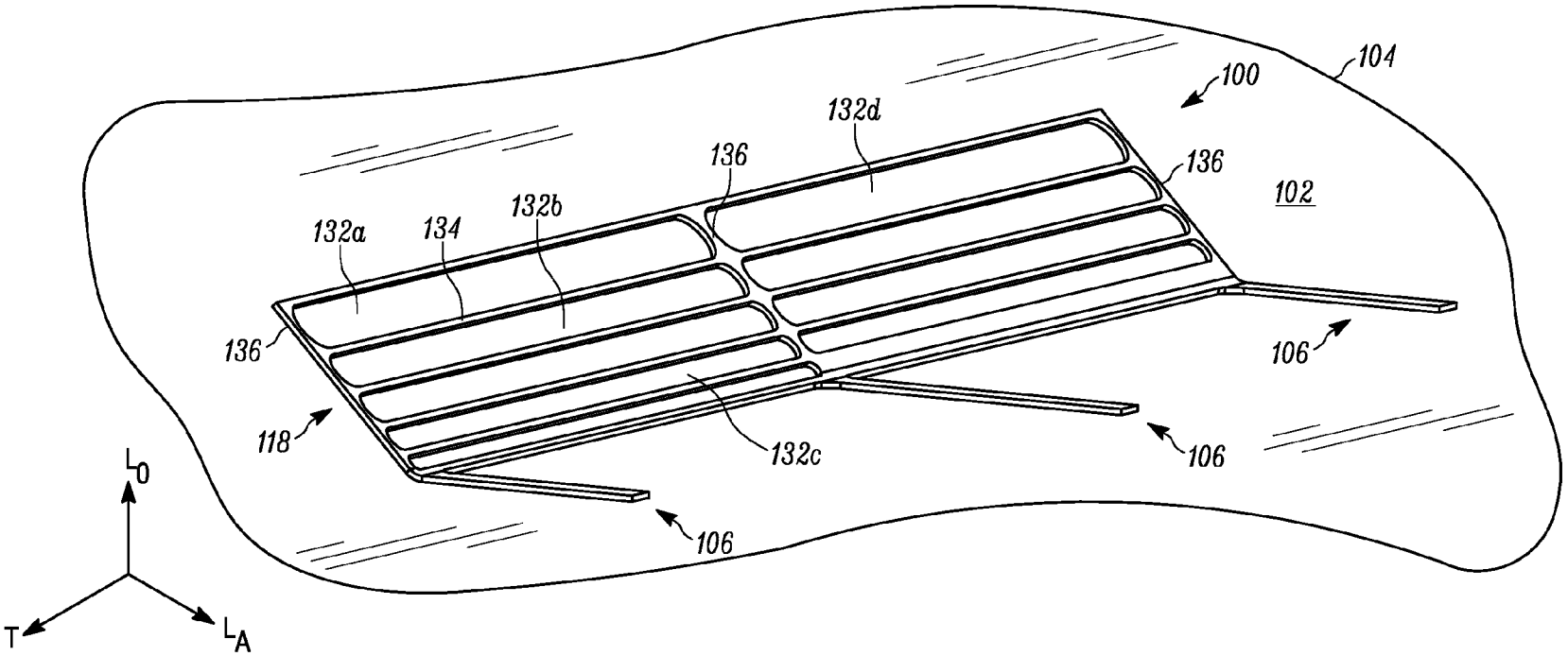
FIG. 1 is a perspective front view of one aspect of the invention.

FIG. 1 depicts an apparatus 100, which could also be termed a "restrictor apparatus", for selectively restricting deposition of a spray coating on a substrate surface 102 of a substrate 104. As referenced herein, the positive orthogonal longitudinal, lateral, and transverse directions are shown as Lo, La, and T, respectively, in FIGS. 1-3. These directional monikers will be used throughout this application for ease of description only, and are not limiting on the claims. Additionally, the terms "downward"/"below" and "upward"/"above", and variants thereof, are used herein to refer to substantially longitudinally oriented headings corresponding to the negative and positive longitudinal directions, as shown in the Figures. Moreover, portions of this application reference a "transverse", "lateral", or "longitudinal" direction when the referenced structures may in fact lie at an angle to one or more of those strict orthogonal directions. In such case, any differences in the non-referenced direction may be disregarded for the sake of description, as will be apparent from context. One of ordinary skill in the art will be able to transpose differently-described directions and relative positions into the directional nomenclature used herein without limiting the present invention thereby.

Figure 2:
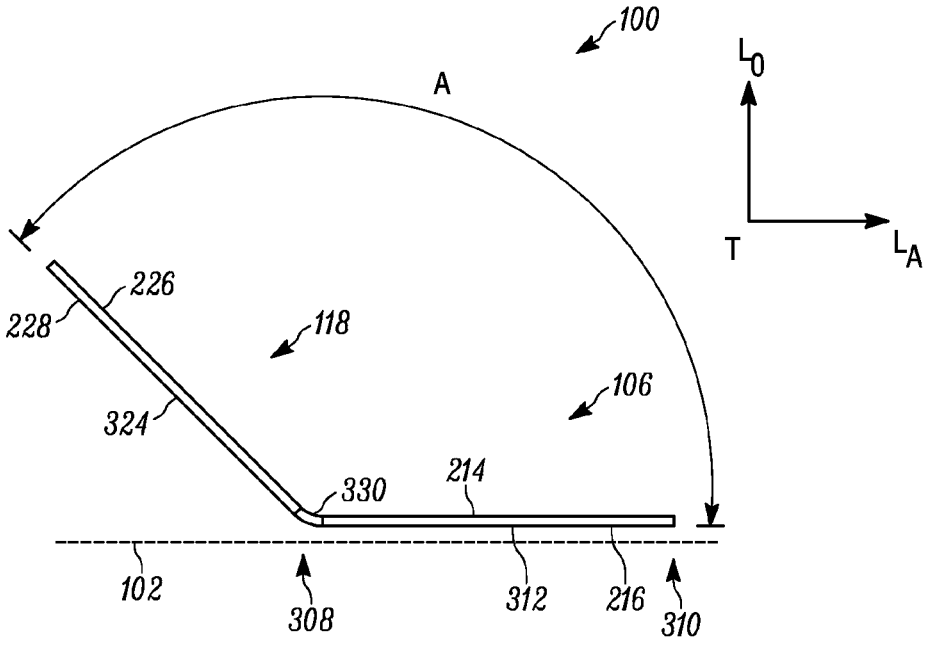
FIG. 2 is a side view of the aspect of FIG. 1.
Figure 3:
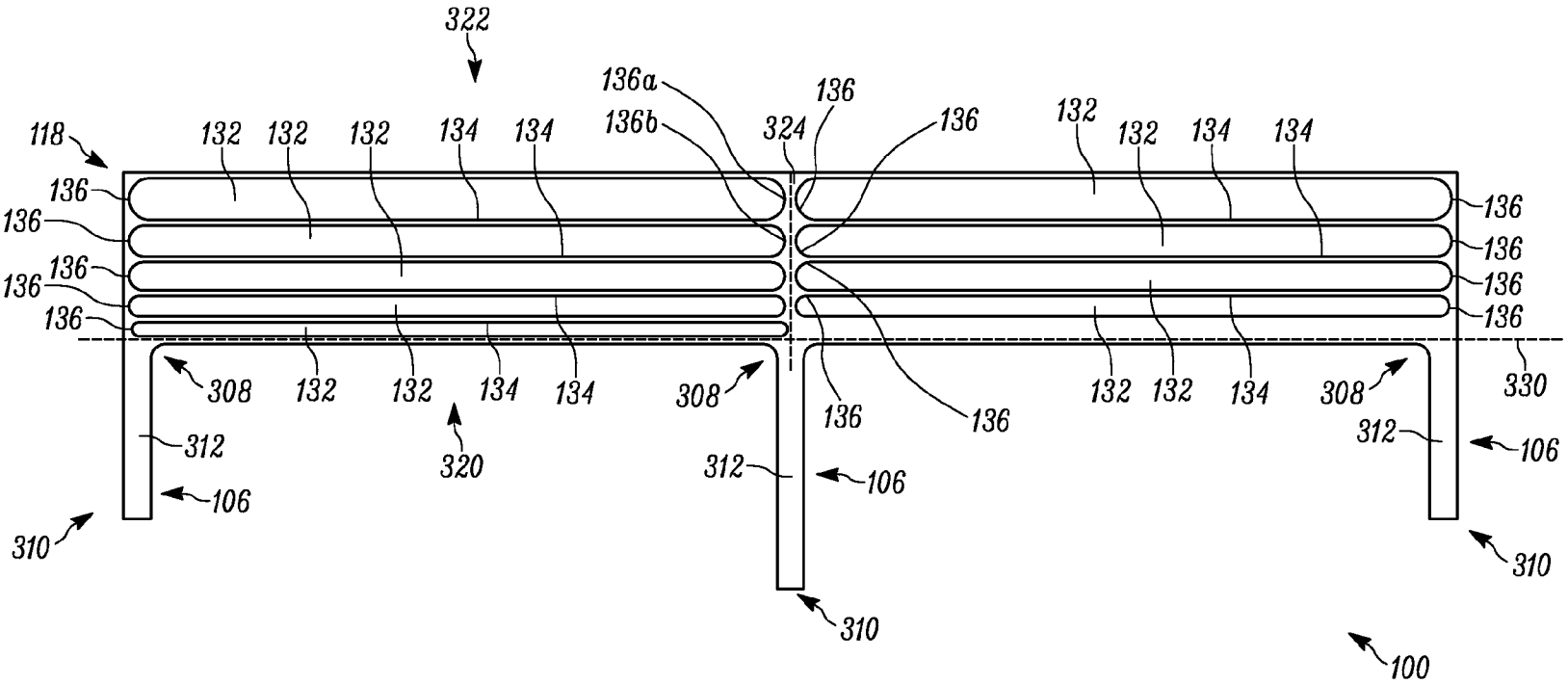
FIG. 3 is a top view of the aspect of FIG. 1.

As shown in FIGS. 1-3, the apparatus 100 includes at least one substrate-contacting stabilizer 106 having laterally spaced inner and outer stabilizer edges 308 and 310, respectively, separated by a stabilizer body 312 having longitudinally separated upper and lower stabilizer surfaces 214 and 216, respectively. The stabilizer(s) 106 may, individually or collectively, have a substantially planar configuration.

The lower stabilizer surface 216 is selectively attachable, with or without intervening structures, to the substrate surface 102 in any desired manner. For example, the stabilizer(s) 106 could be attached to the substrate surface 102 magnetically, adhesively, mechanically (e.g., via clamps, fasteners, or the like), or in any other suitable manner.

The apparatus 100 also includes a restrictor fin 118 having laterally spaced inner and outer fin edges 320 and 322, respectively, separated by a fin body 324 having longitudinally separated upper and lower fin surfaces 226 and 228, respectively. The restrictor fin 118 may have a substantially planar configuration. For some use environments of the apparatus 100, the restrictor fin 118, or any other portions (or the entirety) of the apparatus 100, may have a significantly larger transverse dimension than longitudinal dimension and/or lateral dimension, as will be discussed below.

The inner fin edge 320 is connected to the inner stabilizer edge 308 to form a transversely oriented apparatus apex (shown approximately in dash-dot line at 330 in FIG. 3). The terms "inner" and "outer" are used herein to reference directions laterally toward and away from, respectively, that apparatus apex 330. The connection of the stabilizer 106 and the restrictor fin 118 at the apparatus apex 330 is accomplished with an obtuse angle "A" formed therebetween when viewed in a lateral-longitudinal plane, as shown in FIG. 2. "Obtuse" is used herein to reference an angle exceeding 90 degrees but less than 180 degrees, measured from the stabilizer 106 in the shortest path to the restrictor fin 118, as shown in FIG. 2. For example, angle "A" may be approximately 135°, or have any other value suitable to achieve a desired spray coating result. One of ordinary skill in the art could readily determine, mathematically and/or via experimentation, a suitable angle "A" to achieve a desired deposition of spray coating on the substrate surface 102.

Figure 4:
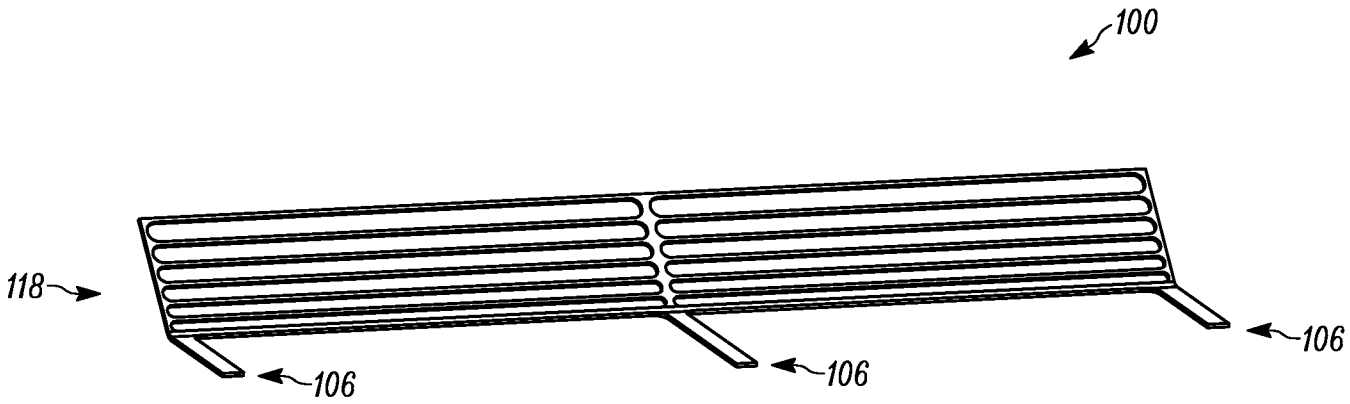
FIG. 4 is a top view of the aspect of FIG. 1.

The apparatus 100 will normally be positioned in use with the lower stabilizer surface(s) 216 in contact with, and/or attached to, the substrate surface 102, optionally with the stabilizer(s) 106 extending substantially coplanarly with the substrate surface 102. (However, it is contemplated that, particularly for nonplanar stabilizers 106, only a portion of the lower stabilizer surface 216 may contact the substrate surface 102 during use.) FIG. 4, however, is a perspective view with the lower fin surface 228 in contact with the substrate surface 102, demonstrating the at least semi-rigid attachment of the stabilizers 106 at the angle A.

Returning to FIGS. 1 and 3, the apparatus 100 also includes a plurality of transversely oriented fin apertures 132 extending through the fin body 324 to place the upper and lower fin surfaces 226 and 228 in fluid communication therethrough. Each laterally adjacent pair of fin apertures (e.g., 132*a* and 132*b* in FIG. 1) defines a transversely oriented restrictor bar 134 from the fin body 324 interposed laterally between the laterally adjacent pair of fin apertures (132*a* and 132*b*, as labeled in FIG. 1). It is also contemplated that the inner- and outermost fin apertures 132 may define restrictor bars 134 in cooperation with the inner and outer fin edges 320 and 322, respectively. Considered differently, at least two restrictor bars 132 may be connected together to cooperatively comprise a restrictor apparatus 100.

Optionally, at least two of the fin apertures 132 may have different lateral dimensions. For example, though the Figures of this application are not to scale, FIGS. 1 and 3 show schematically that the outermost fin aperture 132*a* has a larger lateral dimension than the innermost fin aperture 132*c* of that local portion of the restrictor fin 118. Also as an option, each laterally successive fin aperture 132 may be larger, or smaller, in the lateral dimension than an adjacent fin aperture 132, to provide a graduated "set" of fin apertures 132 as shown, as will be discussed below. As another option, though not shown, laterally successive fin apertures 132 may have differing lateral dimensions in a non-graduated manner, as desired by one of ordinary skill in the art. Different spray coating materials (having different viscosities, cure rates, and other properties) may affect the lateral dimensions of the fin apertures 132 for a particular use environment.

Examples of suitable lateral dimensions of fin apertures 132 include dimensions in the range of about 0.13-0.24 inches (about 3.302-6.096 millimeters). There could be, for example, from about one to about twenty-four fin apertures 132 for a particular use environment corresponding to those lateral dimensions. In any use environment, there may be a plurality of adjacent fin apertures 132 having a substantially similar lateral dimension for a single restrictor fin 118, such that any graduated increase/decrease in dimensions may occur across groups of fin apertures 132 in addition to, or instead of, across single adjacent fin apertures 132.

With reference back to FIGS. 1 and 3, a plurality of transversely oriented fin apertures 132 may extend through the fin body 324 to place the upper and lower fin surfaces 226 and 228 in fluid communication. Each transversely adjacent pair of fin apertures (e.g., 132*a* and 132*d* in FIG. 1) defines a laterally oriented reinforcement bar 136 from the fin body 324 interposed transversely between the transversely adjacent pair of fin apertures (132*a* and 132*b*, as labeled in FIG. 1). It is also contemplated that the transverse extremity fin apertures 132 may define reinforcement bars 136 in cooperation with the respective transversely extreme edges of the restrictor fin 118, respectively.

While "pairs" of laterally or transversely adjacent fin apertures 132 are referenced in this description, at least FIG. 3 shows that a "pair" of "adjacent" fin apertures 132 need not be totally aligned or mirrored in the referenced direction. For example, the left (as shown in the orientation of FIG. 3) group of fin apertures 132 are slightly laterally offset from the right (as shown in the orientation of FIG. 3) group of fin apertures 132, possibly as an artifact of the different number of fin apertures 132 on each (transverse) side of the depicted apparatus 100. The apparatus 100 is therefore agnostic and apathetic as to the number or arrangement of fin apertures 132, other than as affects operation of the apparatus 100.

Figure 5:
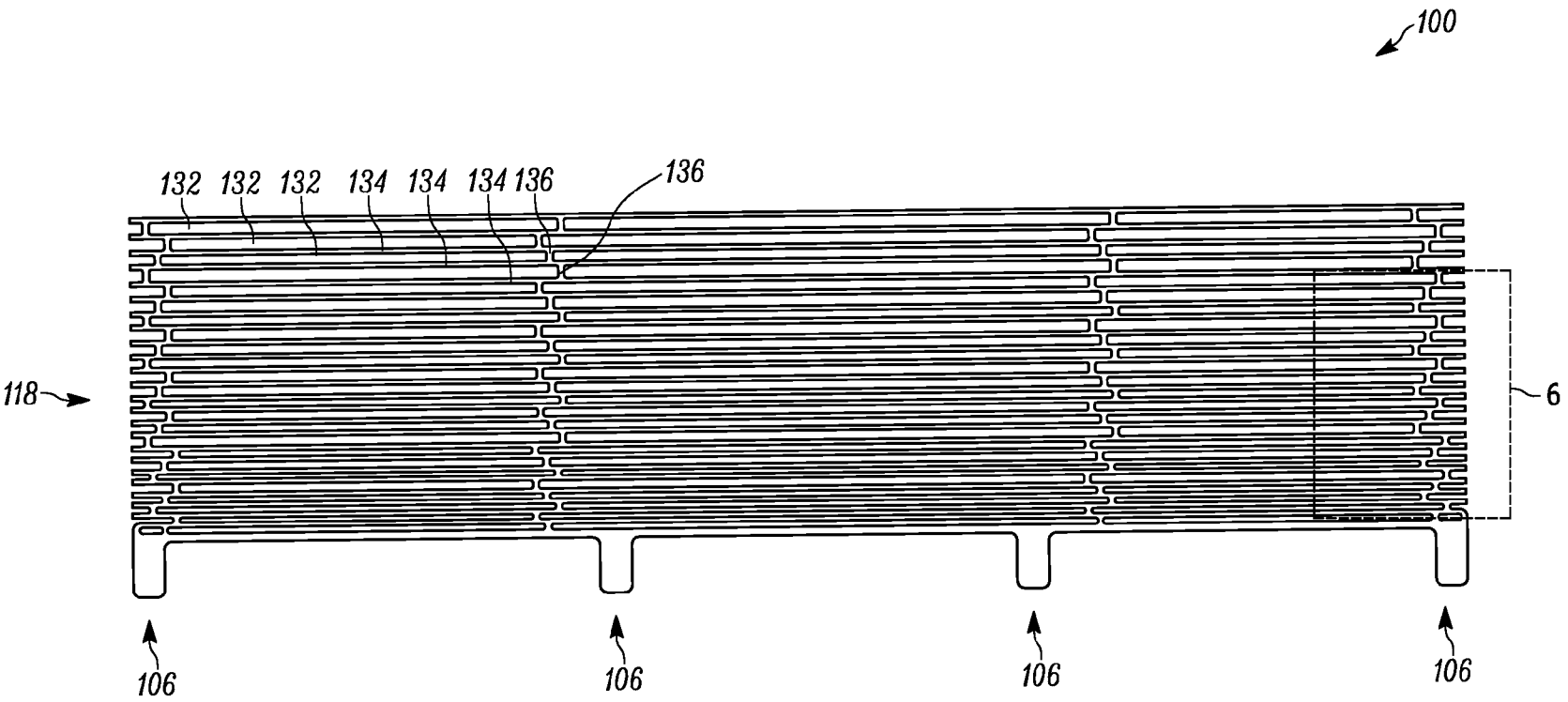
FIG. 5 is a partial top view of the aspect of FIG. 1 in an alternate configuration.
Figure 6:
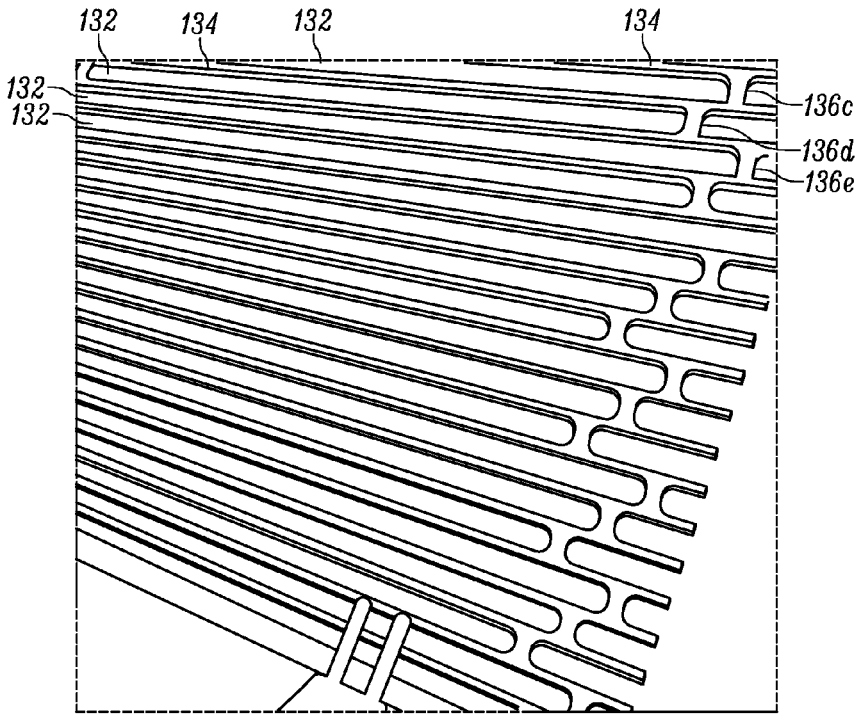
FIG. 6 is a detail view of area "6" of FIG. 5.

In FIG. 3, the reinforcement bars 136 are substantially transversely aligned. That is, a first reinforcement bar 136*a* is at a substantially same location in the transverse direction as is the laterally adjacent second reinforcement bar 136*b*. With reference to FIGS. 5-6, however, it is also contemplated that a first reinforcement bar 136*c* may instead be transversely spaced (i.e., at a different location in the transverse direction) from a laterally adjacent second reinforcement bar 136*d*. Either straight or such "staggered" reinforcement bars 136 may be helpful, for example, in stiffening the restrictor fin 118, and one of ordinary skill in the art may provide a suitably configured apparatus 100 for a particular use environment.

For an apparatus 100 having staggered reinforcement bars 136, as shown in FIGS. 5-6, the reinforcement bars 136 may be arranged in a pattern. One example pattern is shown in FIGS. 5-6, with a third reinforcement bar 136*e* being substantially transversely aligned with the laterally spaced first reinforcement bar 136*c* and other, non-letter-indicated reinforcement bars 136 to form a regular "stepped" pattern. Conversely, the reinforcement bars 136 could be placed without regard to pattern, or even avoiding a pattern, for a particular use environment of the apparatus 100.

It is contemplated that the apparatus 100 could be stamped, laser-cut, die-cut, assembled from subassemblies, or otherwise manufactured as desired by one of ordinary skill in the art. The depicted apparatus 100 of at least FIGS. 1-6 may be machined or otherwise integrally formed from a single piece of a material blank, which could be, for example, 0.040 inch (1.016 millimeter) thick aluminum sheet stock. This material is bent, before or after the depicted structural features are cut or otherwise created, to provide the apparatus apex 330. It is also or instead possible that components of the apparatus 100 could be separately provided and assembled, by the manufacturer and/or the user, at any suitable time before use. Such "modular" assembly, for example, may be desirable if the lateral dimension of the stabilizer body should be shorter for some use environments and longer for others. This, or any other dimensional variance provided by modular construction, may be helpful to a manufacturer and/or user seeking to reduce inventory costs and/or space. A modular aspect to the assembly of the apparatus 100 may facilitate keeping a relatively small inventory of basic components in stock while still being able to provide a wide variety of apparatus 100 sizes and configurations (e.g., different angles A) produced using diverse combinations of those basic components.

Figure 7:
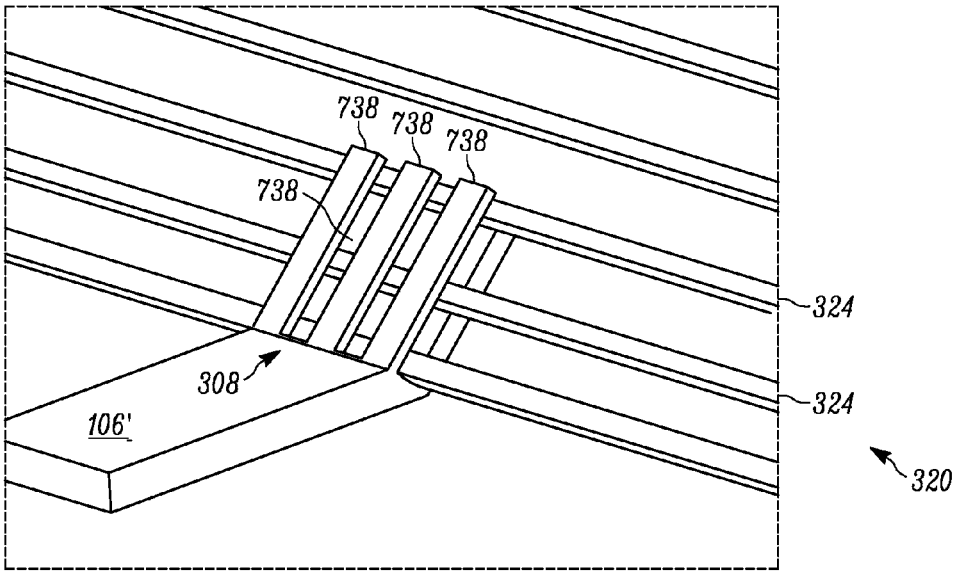
FIG. 7 is a partial perspective front view of the aspect of FIG. 1.

As an example of a basic component which can be used in a modular construction of the apparatus 100, FIG. 7 depicts an example of a detachable stabilizer 106', which can be used in addition to, or instead of, one or more stabilizers 106 which are integrally formed with the restrictor fin 118. The detachable stabilizer 106' includes a plurality of fingers 738 (four shown) extending laterally and longitudinally from the inner stabilizer edge 308. The fingers 738 are configured to cooperatively accept the inner fin edge 320 and thereby support the restrictor fin 118 in the apparatus apex 330 relationship. The fingers 738 may be operative to "pinch" the fin body 324 therebetween in an interference-fit type relationship, or the fingers 738 may just bracket the fin body 324 without exerting significant lateral pressure thereon, other than as provided for the supporting function when the restrictor fin 118 is being held at angle A by the detachable stabilizer 106'.

Figure 8:
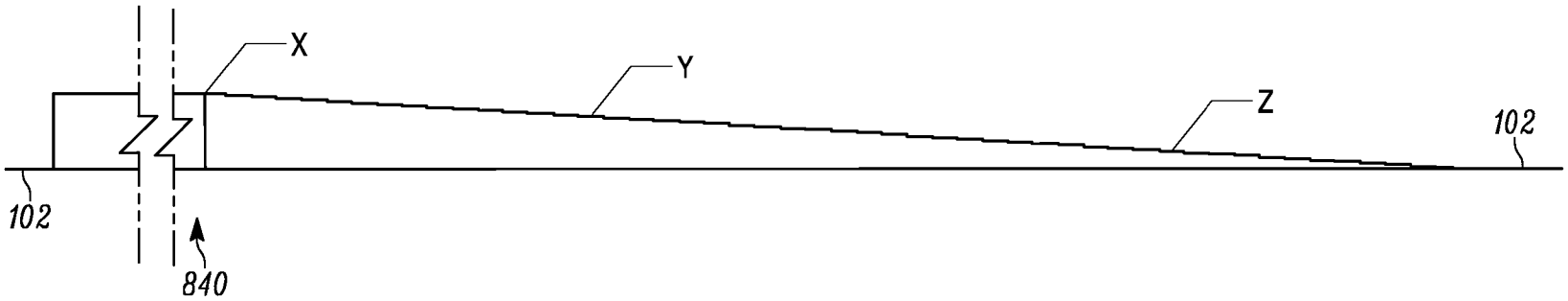
FIG. 8 schematically illustrates a coating application using the aspect of FIG. 1.

FIG. 8 is a schematic cross-sectional view of an example use of the apparatus 100 in applying a spray coating 840 to the substrate surface 102. FIG. 8 depicts a tapered edge of a larger area of coating 840, as shown by the break line in the coating 840 near the left side, in the orientation of FIG. 8. At point "X", and all points to the left of "X", the coating thickness may be, for example, approximately 0.0679 inches (1.72466 millimeters). At point "Y", the coating thickness has tapered down to, for example, approximately 0.0666 inches (1.69164 millimeters). At point "Z", the coating thickness has further tapered down, to, for example, approximately 0.0268 inches (0.68072 millimeters), and then the coating 840 depth gradually approaches, perhaps reaching, a zero-thickness toward the right side of FIG. 8. As can be seen in FIG. 8, the upper surface of the tapered coating area is relatively smooth, since the coating 840 tapers in an "infinitesimal-step" manner, rather than the more distinctly stepped taper formed by the known tape-layer masking methods currently in use. This smooth taper may be desirable in certain use environments.

In order to achieve a desired variable-depth coating thickness upon the substrate surface 102, such as the smoothly tapered cross-section shown in FIG. 8 or any other desired cross-sectional shape, the apparatus 100 may be used to selectively restrict deposition of the spray coating 840 on the substrate surface 102. In use, the apparatus 100 is interposed longitudinally between a spray coating 840 source (e.g., a spray nozzle) and the substrate surface 102. For example, and as shown in FIG. 9, the lower stabilizer surface 216 may be attached (directly or indirectly) to the substrate surface 102 to hold the stabilizer fin 118 at the obtuse angle A.

Figure 9:
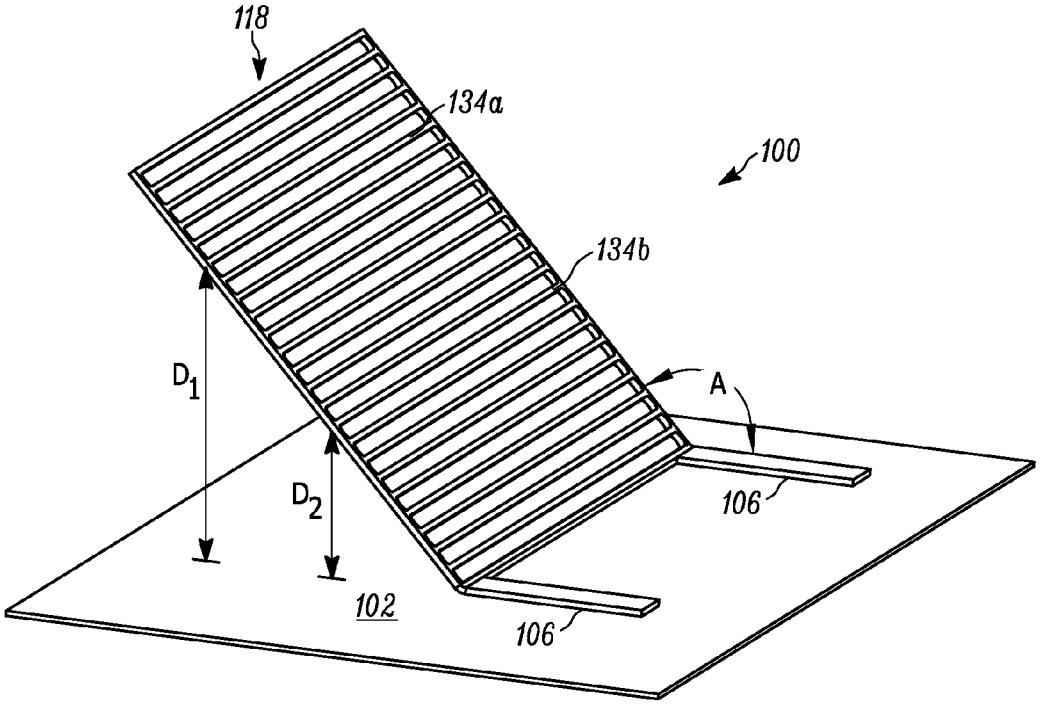
FIG. 9 is a perspective front view of the aspect of FIG. 1 in a first use environment.

Optionally, a propping structure (not shown) may be provided to help maintain the angle between the stabilizer fin 118 and the substrate surface 216 as shown in FIG. 9. However, it is contemplated that, for many use environments of the present invention, it will be desirable to minimize contact of the apparatus 100 with the surface, and so the restrictor fin 118 may be supported above the substrate surface 102 (e.g., at an angle, as depicted) only by cantilever force provided to the restrictor fin 118 by the stabilizer 106. Stated differently, as shown in FIG. 9, the stabilizers 106 are the only portion of the apparatus 100 which contacts the substrate surface 102 during use.

It is contemplated that the stabilizer(s) 106 could have a heavy configuration (e.g., with a separate ballast weight, not shown, and/or a sufficiently large stabilizer body 312) to permit the apparatus 100 to be placed upon the substrate surface 102 with the gravity-assisted weight of the stabilizer itself resisting any "tipping" force from the cantilevered restrictor fin 118, with no separate attachment scheme provided. However, the stabilizer(s) 106 could also or instead be provided with adhesive, magnetic, mechanical, or any other desired type of attachment scheme to suspend the restrictor fin 118 at least partially above the substrate surface 102 as desired.

Regardless of how the suspension shown in FIG. 9 is achieved, however, the restrictor fin 118 is held relatively stably at an angle (e.g., angle A) by attachment of the stabilizer(s) 106 to the substrate surface 102. The spray coating 840 may then be directed substantially longitudinally (optionally with some degree of lateral and/or transverse travel direction, as well) downward onto the upper fin surface 226. During application of the spray coating 840 to the upper fin surface 226, the fin apertures 132 permit at least a portion of the spray coating 840 to pass substantially longitudinally (optionally with some degree of lateral and/or transverse travel direction, as well) therethrough toward the substrate surface 102. The restrictor bars 134, conversely, prevent passage of at least a portion of the applied spray coating 840 toward the substrate surface 102.

By suitable configuration of the restrictor bars 134 (which is functionally equivalent to configuration of the fin apertures 132), optionally considering characteristics of the spray coating 840 source (e.g., direction, spread, and pressure of coating travel) and the coating itself, a user can "tune" the apparatus 100 for a desired blocking effect. For example, the restrictor bars 134 could be arranged in a predetermined bar configuration operative to selectively restrict deposition of the spray coating 840 and thereby facilitate a predetermined cross-sectional profile, when viewed in a lateral-longitudinal plane such as in the view of FIG. 8, of spray coating 840 upon the substrate surface.

For example, and again as shown in FIG. 8, the predetermined cross-sectional profile could be a substantially evenly tapered depth with a minimum thickness (due to the least amount of spray coating 840 allowed through the restrictor fin 118) laterally adjacent to the inner stabilizer edge 308 and a maximum thickness (due to the most amount of spray coating 840 allowed through the restrictor fin 118) laterally spaced from the inner stabilizer edge 308 in a direction toward the outer fin edge 310.

As previously mentioned, the apparatus 100 may be helpful in providing a spray coating 840 having a desired cross-sectional profile upon a substrate 104 which is at least part of a vehicle panel. Because of the various shapes of the vehicle panels, it may be desirable to create a particular cross-sectional profile, such as a tapered edge effect, along a significant and potentially nonlinear distance. To aid in such "complexly" shaped spray coating 840 restrictions, FIGS. 10-12 illustrate example apparatuses 100A-100D including various shapes.

Figure 10:
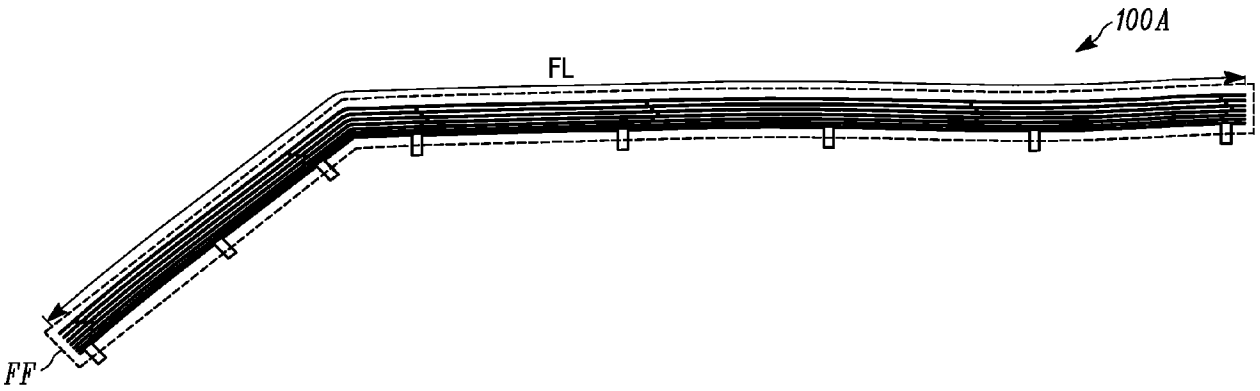
FIGS. 10-12 schematically illustrate various configurations of the aspect of FIG. 1.

As particularly noted in FIG. 10, the directions referred to in the above description as "transverse" and "lateral" directions may be locally transverse and locally lateral directions. In other words, as a fin body 324 changes position in space, the orthogonal directions established in FIGS. 1-3 may also change with that relative frame of reference. The restrictor fin 118 has a fin length (shown as FL in FIG. 10) that is substantially longer than a locally lateral distance between the inner and outer fin edges 320 and 322. The shape of the restrictor fin 118 along the fin length FL defines a fin footprint (shown schematically at dashed line FF) which is apparent in a lateral-transverse plane. Here, the term "footprint" is used to indicate "the area on a surface covered by something". As shown in FIG. 10, the fin footprint FF of apparatus 100A is variably positioned, along the fin length FL, within the lateral-transverse plane.

Stated differently, various local portions of the fin footprint FF may be offset from, in angled relationship to, or otherwise positionally nonuniform in relation with, other local portions of the fin footprint FF, other than the simple variance provided by their different locations along the fin length FL. This differs from a fin footprint (such as that of FIG. 3) which has a regular shape which is substantially positionally uniform within the lateral-transverse plane.

Figure 11B:
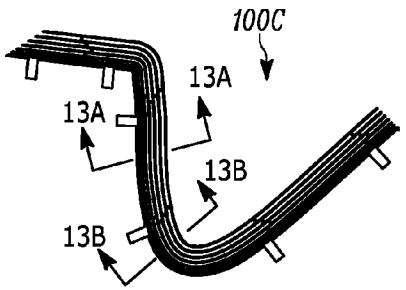
Figure 11A:
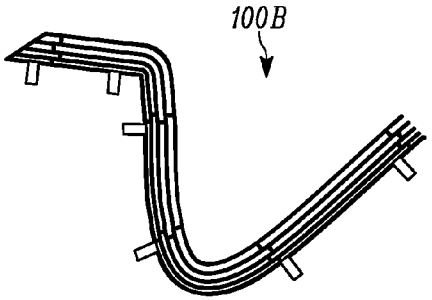
Figure 12:
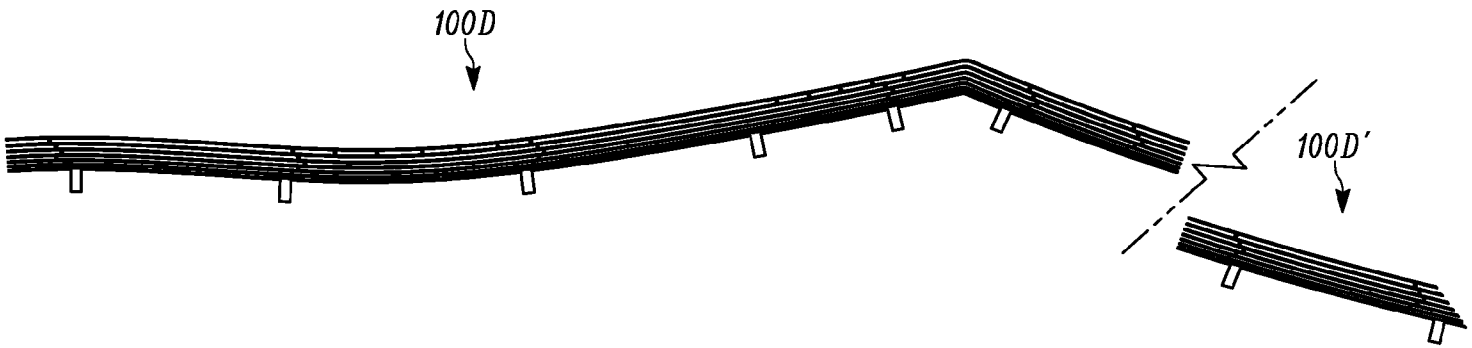

FIGS. 11A-12 are similar to FIG. 10 in that other relatively labyrinthine and nonuniform (e.g., asymmetrical) apparatus 100 shapes are provided, to assist with restricting spray coating 840 in a desired manner. The shapes of the apparatuses 100B and 100C are substantially similar, but the apparatus 100B of FIG. 11A includes fewer "rows" of fin apertures 132 than does the apparatus 100C of FIG. 11B.

Figure 13A:
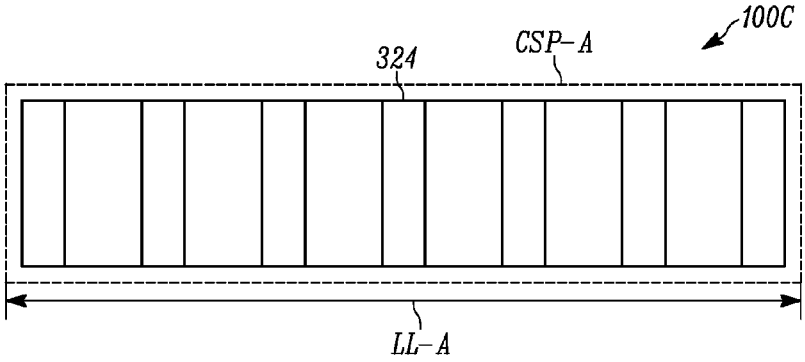
FIGS. 13A and 13B are schematic cross-sections taken along lines 13A and 13B, respectively, of FIG. 11B.
Figure 13B:
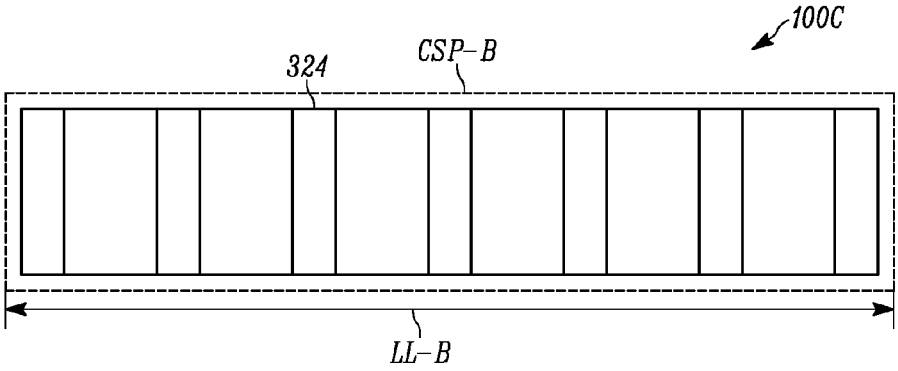

FIG. 11B also illustrates one way in which a restrictor fin 118 can have a variable cross-section. That is, a cross-sectional perimeter of the fin body 324 taken in the lateral-longitudinal plane may vary responsive to a position of the cross-sectional perimeter along the fin length FL. This variance is depicted in FIGS. 13A-13B which, like all Figures herein, are not drawn to scale. In FIG. 13A, a cross-sectional perimeter CSP-A of the fin body 324 of the apparatus 100C is shown taken along line 13A of FIG. 11B, at a first position along the fin length FL. This cross-sectional perimeter CSP-A has a lateral length LL-A. In FIG. 13B, a cross-sectional perimeter CSP-B of the fin body 324 of the apparatus 100C is shown taken along line 13B of FIG. 11B, at a second position along the fin length FL. This cross-sectional perimeter CSP-B has a lateral length LL-B, which is different from the lateral length LL-A of the cross-sectional perimeter CSP-A. Here, the variance is at least partially because line 13B extends across a curve of the restrictor fin 118 of the apparatus 100C, which naturally differs from the lateral length of a "straightaway" such as at line 13A. One of ordinary skill in the art could readily configure an apparatus having any desired cross-sectional perimeter CSP, fin footprint FF, fin length FL, or any other physical properties.

FIG. 12 is an exploded view of a multi-piece device including a first apparatus 100D and a second apparatus 100D', which is selectively detachable from the first apparatus 100D. In FIG. 12, the restrictor fin 118 can be split, through removal of the second apparatus 100D', during or after application of the spray coating 840 for a desired coating effect and/or to accommodate a local irregularity of the substrate 104.

Figure 14:
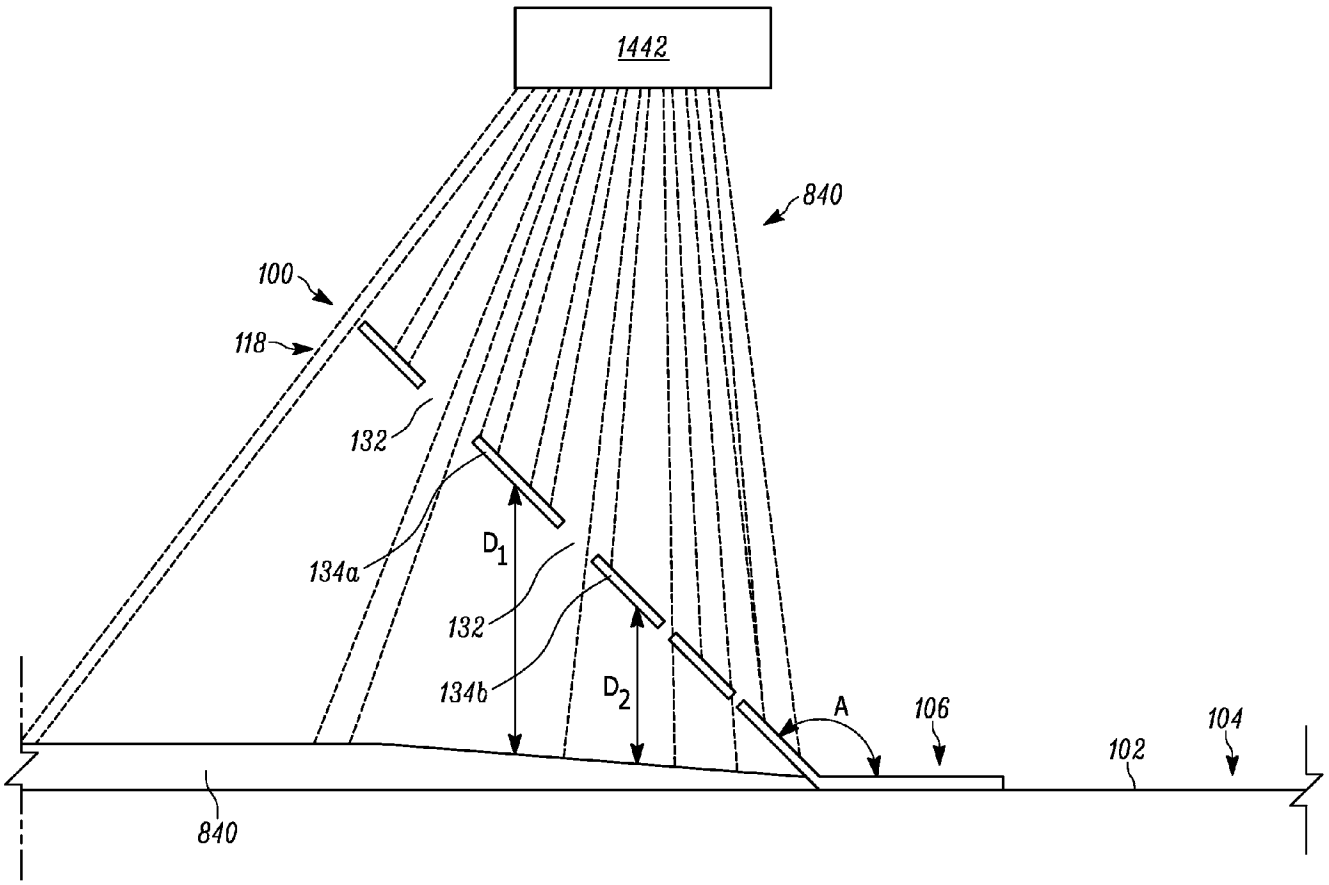
FIG. 14 is a schematic partial side view of the aspect of FIG. 1 in the first use environment.

FIG. 14 is a schematic side view of the apparatus 100 being used to affect at least a portion of a spray coating 840 directed substantially longitudinally onto the upper fin surface 226 when the lower stabilizer surface 216 is attached to the substrate surface 102 by selectively restricting deposition of spray coating 840, supplied from a coating source 1442, on a substrate surface 102 of a substrate 104. As shown in FIG. 14, at least a portion of the spray coating 840 from the coating source 1442 is being blocked from reaching the substrate surface 102 via a first substantially transversely extending restrictor bar 134*a* located a first longitudinal distance D1 above the substrate surface 102. At least a portion of the spray coating 840 from the coating source 1442 is being blocked from reaching the substrate surface 102 via a second substantially transversely extending restrictor bar 134*b* located a second longitudinal distance D2, which is less than the first longitudinal distance D1, above the substrate surface 102. The second restrictor bar 134*b* is laterally spaced from the first restrictor bar 134*a*. At least a portion of the restrictor apparatus 100 is placed into contact with the substrate surface 102 to establish and maintain the first and second longitudinal distances D1 and D2 of the first and second restrictor bars 134*a* and 134*b*.

Additional transversely extending restrictor bars 134, such as those shown in FIG. 14, may be provided. Each additional restrictor bar 134 will be located a longitudinal distance above the substrate surface 102 which is different from the first and second longitudinal distances D1 and D2, because of the angular relationship (at angle A) between the stabilizer 106 and the restrictor fin 118.

As is apparent from FIG. 14, at least a portion of the spray coating 840 streams (examples of these streams are shown by the dashed lines in FIG. 14) travel cleanly through the fin apertures 132 in a direct line between the coating source 1442 and the substrate surface 102. However, as was omitted from FIG. 14 for clarity, it is also contemplated that portions of the spray coating 840 streams may be deflected by the fin body 324 and change their travel direction during passage through the restrictor fin 118. Another non-depicted fluid movement effect is a secondary aerodynamic effect, such as vortices forming from the result of the spray coating 840 interacting with the apparatus 100 and/or the substrate 104.

One of ordinary skill in the art, optionally with the assistance of computer-aided computations (e.g., fluid modeling), will be able to use the teachings herein—potentially in combination with primary and secondary aerodynamic considerations—to create an apparatus 100, of any configuration in accordance with these teachings, having a desired restrictive effect upon the application of spray coating 840 to a substrate 104 in a particular use environment. For example, the angle A may differ based upon the pressure or spread of spray coating 840 from a particular coating source 1442. However, such fine-tuning of the concepts herein for a desired result in practice will be considered to fall within the scope of this disclosure.

Deposition of the spray coating 840 upon the substrate surface 102 may be restricted, such as through use of the method depicted in FIG. 14, during a single, substantially continuous application pass of the spray coating 840. This "one-pass" application may be accomplished with a stationary and/or moving (relative to the substrate 104) coating source 1442.

Such a single, substantially continuous application pass is distinguished from the prior art practices of "stripping away" layers of masking tapes, etc., between coats of spray coating 840 to gradually create the desired cross-sectional profile across a number of passes of the spray coating 840. However, the apparatus 100 could be used, if desired, to restrict deposition of spray coating 840 during a multi-pass process.

It is contemplated, as alluded to above at least with reference to FIGS. 10-12, that the fin apertures 132 may vary in size, shape, configuration, position upon the restrictor fin 118, cross-sectional profile, or other physical properties suitable to produce a desired restriction of spray coating deposition, such as to provide a resultant deposition of spray coating upon the substrate surface 102 in any two- or three-dimensional configuration as desired. The desired coating thickness profile, e.g., of the spray coating may be affected by the dimensions and positioning of the fin apertures 132. As one example, to achieve a tapered cross-sectional shape, it may be desirable to have the successive fin apertures 132 each have smaller and smaller lateral heights, in the direction of taper. As another example, to achieve a rippled or wavy surface, such a corrugated effect could be achieved by provision of equal-height fin apertures 132. One of ordinary skill in the art can make modifications in accordance with the teachings herein to provide an appropriately dimensioned apparatus 100 for any desired spray coating result.

In a manufacturing environment, for example, the apparatus 100 may be used to help control the application of spray coatings. In this use environment, the restrictor fin 118 could be considered to be a shadow mask 118, which would allow the stabilizer(s) 106 to be considered mask support(s) 106. Mask apertures 132 would then allow passage therethrough of an applied spray coating substantially similarly to the process described above.

While aspects of this disclosure have been particularly shown and described with reference to the example embodiments above, it will be understood by those of ordinary skill in the art that various additional embodiments may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. A "predetermined" status may be determined at any time before the structures being manipulated actually reach that status, the "predetermination" being made as late as immediately before the structure achieves the predetermined status. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one embodiment or configuration could be provided, singly or in combination with other structures or features, to any other embodiment or configuration, as it would be impractical to describe each of the embodiments and configurations discussed herein as having all of the options discussed with respect to all of the other embodiments and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

We claim:

1. A method for selectively restricting deposition of a spray coating on a substrate surface of a substrate, the substrate extending in a lateral-transverse plane defined by mutually orthogonal lateral and transverse directions, a longitudinal direction being orthogonal to both the lateral and transverse directions, the method comprising:

directing the spray coating substantially longitudinally downward from a coating source toward the substrate surface;

blocking at least a portion of the spray coating from reaching the substrate surface via a first substantially transversely extending restrictor bar located a first longitudinal distance above the substrate surface; and blocking at least a portion of the spray coating from reaching the substrate surface via a second substantially transversely extending restrictor bar located a second longitudinal distance, which is less than the first longitudinal distance, above the substrate surface, the second restrictor bar being entirely laterally spaced from the first restrictor bar.

2. The method of claim 1, wherein the first and second restrictor bars are connected together to cooperatively comprise a restrictor apparatus.

3. The method of claim 1, including placing at least a portion of the restrictor apparatus into contact with the substrate surface to establish and maintain the first and second longitudinal distances of the first and second restrictor bars.

4. The method of claim 1, including blocking at least a portion of the spray coating from reaching the substrate surface via at least one additional transversely extending restrictor bar, each additional restrictor bar being located a longitudinal distance above the substrate surface which is different from the first and second longitudinal distances.

5. The method of claim 1, including selectively restricting deposition of the spray coating and thereby facilitating creation of a predetermined cross-sectional profile, which includes restricting deposition of the spray coating upon the substrate surface to a substantially evenly tapered depth.

6. The method of claim 1, including selectively restricting deposition of the spray coating and thereby facilitating creation of a predetermined cross-sectional profile, which includes restricting deposition of the spray coating upon the substrate surface to the predetermined cross-sectional profile during a single, substantially continuous application pass of the spray coating.

7. The method of claim 1, wherein blocking at least a portion of the spray coating from reaching the substrate surface via a first substantially transversely extending restrictor bar, and blocking at least a portion of the spray coating from reaching the substrate surface via a second substantially transversely extending restrictor bar include, respectively:

blocking at least a portion of the spray coating from reaching the substrate surface via a first restrictor bar extending substantially transversely and extending at a small bar angle in the lateral-transverse plane; and blocking at least a portion of the spray coating from reaching the substrate surface via a second restrictor bar extending substantially transversely and extending at the small bar angle in the lateral-transverse plane.

* * * * *